US012232569B2

(12) United States Patent
Bell et al.

(10) Patent No.: US 12,232,569 B2
(45) Date of Patent: Feb. 25, 2025

(54) ARTICLE OF FOOTWEAR WITH INTEGRALLY KNIT TONGUE

(71) Applicant: NIKE, Inc., Beaverton, OR (US)

(72) Inventors: Torrey J. Bell, Portland, OR (US); Zhu Feixiang, Ningbo (CN); Casey Pierson, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 216 days.

(21) Appl. No.: 17/737,397

(22) Filed: May 5, 2022

(65) Prior Publication Data

US 2022/0369768 A1 Nov. 24, 2022

Related U.S. Application Data

(60) Provisional application No. 63/191,025, filed on May 20, 2021.

(51) Int. Cl.

| | |
|---|---|
| ***A43B 23/26*** | (2006.01) |
| ***A43B 1/04*** | (2022.01) |
| ***A43B 23/02*** | (2006.01) |

(52) U.S. Cl.
CPC ..... *A43B 23/26* (2013.01); *A43B 23/025* (2013.01); *A43B 1/04* (2013.01)

(58) Field of Classification Search
CPC ..... A43B 23/26; A43B 23/025; A43B 1/04; A43B 23/04
See application file for complete search history.

(56) References Cited

U.S. PATENT DOCUMENTS

| | | | | |
|---|---|---|---|---|
| 8,973,410 | B1 * | 3/2015 | Podhajny | D04B 21/207 36/47 |
| 2015/0216255 | A1 | 8/2015 | Podhajny | |
| 2016/0066651 | A1 | 3/2016 | Terai et al. | |
| 2017/0135435 | A1 | 5/2017 | Ikenaka et al. | |
| 2020/0046074 | A1 * | 2/2020 | Berrian | D04B 1/26 |
| 2020/0181816 | A1 * | 6/2020 | Meir | D04B 7/04 |

OTHER PUBLICATIONS

Office Action received for European Application No. 22726919.8, mailed on Jan. 4, 2024, 3 pages.
International Search Report and Written Opinion received for PCT Patent Application No. PCT/US2022/028562, mailed on Jul. 20, 2022, 12 pages.

* cited by examiner

*Primary Examiner* — Khoa D Huynh
*Assistant Examiner* — Erick I Lopez
(74) *Attorney, Agent, or Firm* — Shook, Hardy & Bacon L.L.P.

(57) ABSTRACT

A knitted component for an article of footwear comprises a knit element and a tongue integrally knitted with the knit element. The knit element includes a lateral throat portion overlapping a lateral edge of the tongue and a medial throat portion overlapping a medial edge of the tongue. The lateral throat portion and the tongue are joined by a first knit structure, and the medial throat portion and the tongue are joined by a second knit structure. The first and second knit structures each include one or more courses having a plurality of knit stitches. Each knit structure may also span multiple adjacent courses. A method of manufacturing the knitted component is also described herein.

14 Claims, 7 Drawing Sheets

130

ARTICLE OF FOOTWEAR WITH INTEGRALLY KNIT TONGUE

CROSS-REFERENCE TO RELATED APPLICATIONS

This application, entitled "Article of Footwear With Integrally Knit Tongue," claims the benefit of priority of U.S. Prov. App. No. 63/191,025, entitled "Article of Footwear With Integrally Knit Tongue," and filed May 20, 2022. The entirety of the aforementioned application is incorporated by reference herein.

TECHNICAL FIELD

Aspects herein relate to an article of footwear with a knitted component forming an integrally knit tongue.

BACKGROUND

Conventional articles of footwear generally include an upper and a sole structure. The upper is secured to the sole structure and forms a void within the article of footwear for comfortably and securely receiving a foot. The upper of the article of footwear generally extends over the instep and toe areas of the foot, along the medial and lateral sides of the foot, and around the heel area of the foot. Access to the void on the interior of the upper is generally provided by an ankle opening in a heel area of the footwear. A lacing system is often incorporated into the upper to adjust the fit of the upper, thereby facilitating entry and removal of the foot from the void within the upper. The upper may include a tongue that extends under the lacing system to enhance adjustability of the footwear.

Uppers may be formed by a variety of materials, including knitted textiles. To help provide access to the foot-receiving void, the sides of a knit tongue may be at least partially detached within the knitted throat region to enable widening of the opening to the void. If a large portion of the tongue is detached, the tongue may inadvertently slide relative to the rest of the knitted throat region. On the other hand, a tongue that is entirely or mostly attached along the sides of the throat region may be more vulnerable to being stretched out or torn as a wearer tries to widen the foot-receiving opening. Additionally, uppers with integrally knit tongues may become worn or tear more easily at the connection point(s) between the tongue and the rest of the knitted throat with a weak knit connection.

BRIEF DESCRIPTION OF THE DRAWINGS

This technology is described in detail herein with reference to the attached drawing figures, which are incorporated herein by reference, wherein.

DETAILED DESCRIPTION

Figure 1:
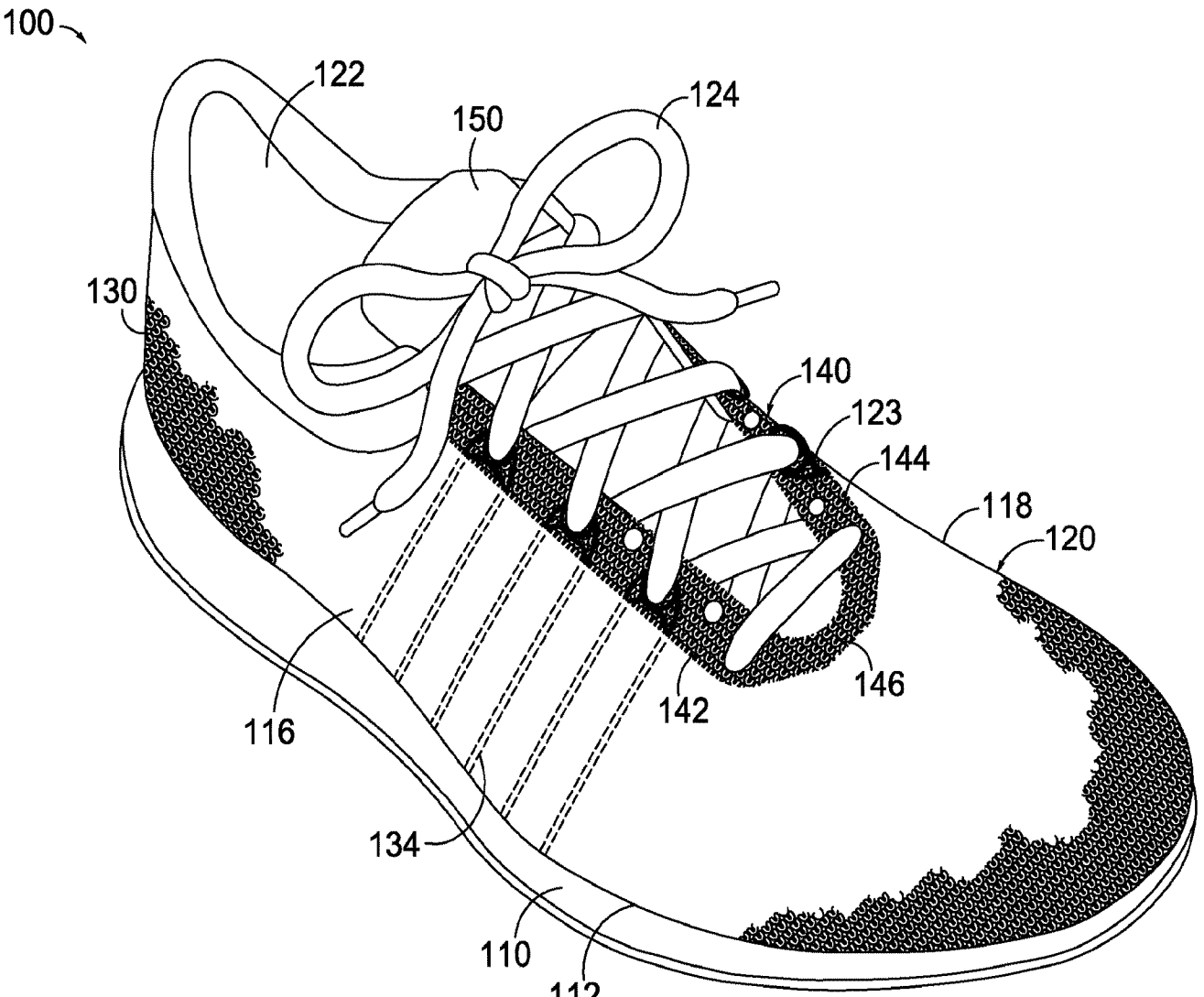
FIG. 1 depicts front, lateral side perspective view of an article of footwear in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to identify different elements of methods employed, the terms should not be interpreted as implying any particular order among or between various steps herein disclosed unless and except when the order of individual steps is explicitly stated.

Conventional articles of footwear generally include an upper and a sole structure. The upper is secured to the sole structure and forms a void within the article of footwear for comfortably and securely receiving a foot. The sole structure is secured to a lower surface of the upper so as to be positioned between the upper and the ground. In some articles of athletic footwear, for example, the sole structure may include a midsole and an outsole. The upper of the article of footwear generally extends over the instep and toe areas of the foot, along the medial and lateral sides of the foot, and around the heel area of the foot. Access to the void on the interior of the upper is generally provided by an ankle opening in a heel area of the footwear. A lacing system is often incorporated into the upper to adjust the fit of the upper, thereby facilitating entry and removal of the foot from the void within the upper. The upper may include a tongue that extends under the lacing system to enhance adjustability of the footwear.

Uppers may be formed by a variety of materials, including knitted textiles. In some uppers, the tongue is knitted integrally with other portions of the upper, such as the knitted throat region. To help provide access to the foot-receiving void, the sides of a knit tongue may be at least partially detached within the knitted throat region to enable widening of the opening to the void. If a large portion of the tongue is detached, the tongue may inadvertently slide relative to the rest of the knitted throat region. On the other hand, a tongue that is entirely or mostly attached along the sides of the throat region may be more vulnerable to being stretched out or torn as a wearer tries to widen the foot-receiving opening. Additionally, uppers with integrally knit tongues may become worn or tear more easily at the connection points between the tongue and the rest of the knitted throat with a weak knit connection.

At a high level, various aspects of this disclosure are directed to a knitted component for an article of footwear with an integrated tongue. The knitted component includes a knit element forming at least a forefoot region and at least part of a throat region of the upper. The knitted component also includes a tongue integrally knit with the knit element and extending through the throat region. A lateral throat portion of the knit element overlaps the lateral edge of the tongue, while a medial throat portion of the knit element overlaps the medial edge of the tongue. A first knit structure joins the lateral throat portion to the tongue, and a second knit structure joins the medial throat portion to the tongue. The first and second knit structures include one or more knit courses that each have a plurality of consecutive knit stitches, such as eight consecutively formed knit stitches, forming the knit structures. Using the plurality of consecutive knit stitches may increase the strength of the connections between the tongue and the medial and lateral sides of the throat.

The tongue includes a lateral section and a medial section extending between the first knit structure and the second knit structure, respectively, and the rearward edge of the tongue. These lateral and medial sections may be detached such that they can move independently of the knit element and may be moved to widen an opening to access a foot-receiving void within the article of footwear. In example aspects, the tongue has a double knit construction, which may provide more structure and increase durability of the tongue. At least the detached lateral and medial throat portions may have a single knit construction, which may create a more streamlined, aerodynamic configuration when these portions overlay the tongue. The first and second knit structures joining the tongue and the first and second knit portions may have double knit constructions. Additionally, the tongue, as well as the first and second knit structures, may have full gauge knit structures, and the lateral and medial throat portions overlaying the tongue may have half-gauge knit structures.

Aspects of this disclosure may further include a method of manufacturing a knitted component for an article of footwear. The method may include knitting a tongue with a knitting machine and then knitting a first portion of a knit element, which may form either a lateral or medial throat portion, while the tongue is being held on needles in the knitting machine. A second portion of the knit element, which may include the other of the lateral or medial throat portion, may be knit with the knitting machine while the tongue and the first portion are both held on needles. The tongue is joined to the first portion by knitting a first knit structure, and the tongue is joined to the second portion by knitting a second knit structure. The first and second knit structures may each include knitting one or more courses each having a plurality of knit stitches. Each of the first and second knit structures may span multiple adjacent courses, where the portions of each course forming the first and second knit structures may include the plurality of knit stitches.

As described, certain aspects of the present disclosure relate to articles of footwear or aspects thereof that are at least partially formed from knitted textiles. In an illustrative example, aspects are directed to an upper formed of a knit element. As used herein, the term "upper" refers to a footwear component that extends over the instep and toe areas of the foot, along the medial and lateral sides of the foot, and around the heel area of the foot to form a void for receiving a wearer's foot. Illustrative, non-limiting examples of uppers may include uppers incorporated into a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. Further, in other aspects, the upper may also be incorporated into a non-athletic shoe, such as a dress shoe, a loafer, and a sandal. Accordingly, the concepts disclosed with respect to articles of footwear apply to a wide variety of footwear types.

Positional terms used when describing the upper, such as top, bottom, front, sides, back, superior, inferior, lateral, medial, right, left, inner-facing, and outer-facing and the like, are used with respect to the upper being worn as intended with the wearer standing upright such that the wearer's foot is in the foot-receiving void and the wearer's ankle or leg extends through the ankle opening. It should be understood, however, that use of positional terms do not depend on the actual presence of a human being for interpretative purposes.

The terms "knitted component" and "knit element" refers to a textile piece that is formed from at least one yarn that is manipulated (e.g., with a knitting machine) to form a plurality of intermeshed loops that define courses and wales. The term "course," as used herein, refers to a predominantly horizontal row of knit loops (in an upright textile as knit) that are produced by adjacent needles during the same knitting cycle. The course may comprise one or more stitch types, such as a knit stitch, a held stitch, a float stitch, a tuck stitch, a transfer stitch, a rib stitch, and the like as these terms are known in the art of knitting. The term "knit stitch," as used herein, refers to the basic stitch type where the yarn is cleared from the needle after pulling a loop of the yarn from the back to the front of the textile through a previous stitch. The term "wale," as used herein, is a predominantly vertical column of intermeshed or interlooped knit loops, generally produced by the same needle at successive (but not necessarily all) courses or knitting cycles. The terms "horizontal" and "vertical" as used herein are relative to an upright textile as knit in which the heads of knit loops face toward the top of the textile and the course knit first is oriented towards the bottom of the textile.

The term "integrally knit," as used herein, may mean a knit textile having a yarn from one or more knitted courses in a first area being interlooped with one or more knitted courses of another area. The interlooping may be through a simple knit stitch, a tuck stitch, a held stitch, a float or miss stitch, and the like. In this way, areas that are integrally knit together have a seamless transition.

As used herein, the term "double knit construction" refers a textile or textile portion knit on a machine with two sets of needles in two needle beds or cylinders. Aspects herein contemplate the machine comprising a weft knit (flat knit) machine. The term "bed" is typically used when describing flat knit machines. To describe a textile with a double knit construction in a different way, the term double knit construction means a textile having front courses formed on a first needle bed and back courses formed on a second needle bed. The front courses of a double knit constructed textile are courses of interlooped stitches forming a front layer of the textile, and the back courses are courses of interlooped stitches forming a back layer of the textile such that the front layer and the back layer of the textile may be formed at substantially the same time. As used herein, the term "front layer" refers to a textile layer that is configured to face externally when the article incorporating the textile, such as the upper, is worn, and the term "back layer" refers to a textile layer that is configured to be facing a skin surface of the wearer when the article is worn.

The term "knitting direction," as used herein, refers to the direction on a knit article, such as an upper, in which courses are sequentially knitted. The knitting direction may refer to a direction when the knitted component forming the article is laid out flat, prior to forming into the article. For instance, where courses forming the top of an integrally knitted component are knit prior to courses forming the bottom of the knitted component, the knitting direction may be considered either top to bottom or, more generally, vertical; whereas, when courses forming a right side of an integrally knitted component are knit prior to courses forming the left side, the knitting direction may be considered either right to left or, more generally, horizontal. Additionally, there are various numerical measurements provided herein. Unless indicated otherwise, the term "about" or "substantially" with respect to a measurement means within ±10% of the indicated value.

Figure 2:
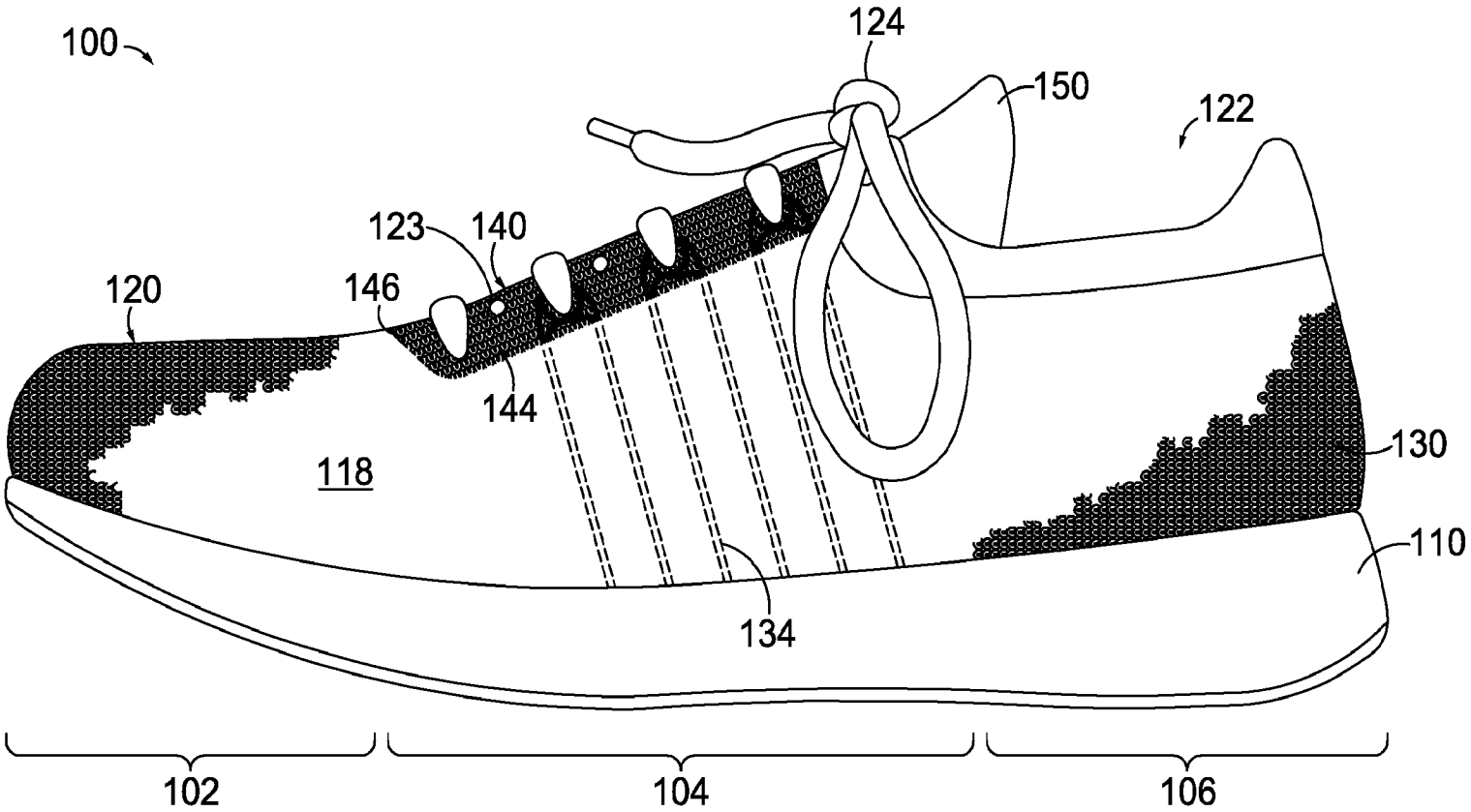
FIG. 2 depicts a medial side view of the article of footwear of FIG. 1 in accordance with aspects herein.

FIGS. 1 and 2 depict a front, lateral side perspective view and a medial side view, respectively, of an example article of footwear 100. The footwear 100 includes an upper 120 secured to a sole structure 110. The area of the footwear 100 where the sole structure 110 joins the upper 120 may be referred to as the biteline 112. The upper 120 may be joined to the sole structure 110 in a fixed manner using any suitable technique, such as through the use of an adhesive, by sewing, etc. It is contemplated that the upper 120 may extend partially or completely around the foot of a wearer, may extend under the foot of a wearer, and/or may be integral with the sole, and a sockliner, which may be referred to as a strobel, may or may not be used.

The footwear 100 may be divided into three general regions: a forefoot region 102, a midfoot region 104, and a heel region 106. The forefoot region 102 generally includes portions of the footwear 100 corresponding to the toes and joints connecting the metatarsals with the phalanges when the footwear 100 is worn. The midfoot region 104 generally includes portions of the footwear 100 corresponding with an arch of the foot when the footwear 100 is worn. The heel region 106 generally corresponds with rear portions of the foot, including the heel and calcaneus bone when the footwear 100 is worn. The footwear 100 also includes a lateral side 116 and a medial side 118, which each extend through regions 102, 104, and 106, and correspond to opposite sides of the footwear 100. More particularly, the lateral side 116 corresponds with an outside area of the foot (i.e., the side that faces away from the other foot) when the footwear 100 is worn, while the medial side 118 corresponds with an inside area of the foot (i.e., the side that faces towards the other foot) when the footwear 100 is worn. These regions 102, 104, and 106 and sides 116 and 118 are not intended to demarcate precise areas of the footwear 100 but, rather, are intended to represent general areas of the footwear 100 to aid in understanding the various descriptions provided herein.

Sole structure 110 generally extends between the foot and the ground when the footwear 100 is worn. The sole structure 110 may include multiple components, such as an outsole, a midsole, and an insole or sockliner. Various materials may be used to form the sole structure 110, such as rubber, ethylene vinyl acetate (EVA), thermoplastic polyurethane (TPU), thermoplastic elastomer (e.g., polyether block amide), and the like. The sole structure 110 may also include various other elements, such as a heel counter and a toe cap. The sole structure 110 may include various other features to attenuate forces, enhance stability, and/or provide traction, such as treads as understood by one skilled in the art.

The upper 120 defines a void within the footwear 100 for receiving and securing a foot relative to the sole structure 110. Access to the void is provided by an ankle opening 122 located in at least the heel region 106. The upper 120 includes a throat region 140 disposed in the midfoot region 104 between the ankle opening 122 and the forefoot region 102. The throat region 140 may be configured to cover a top side of the wearer's foot and, therefore, form part of a top side (or overfoot region) of the upper 120 between the lateral side 116 and the medial side 118.

At least a portion of the upper 120 may be formed of at least one knitted component 130, such as by a weft-knitting process or a warp-knitting process on a flat knitting machine, for example. In some aspects, substantially the entire of the upper 120 or the entire upper 120 may be formed of the knitted component 130. The knitted component 130 may be formed as a single integral one-piece element during a knitting process, such as weft knitting, warp knitting, or any other suitable knitting process. Additional elements, such as an underfoot portion and/or a heel element (including, but not limited to a heel counter or other elements or components) may be integrally formed with the upper 120 as a one-piece unitary structure. Alternatively, one or more such additional elements may be formed separately from the upper 120 and then later attached, secured, or otherwise assembled as necessary. Forming the upper 120 with the knitted component 130 may provide the upper 120 with advantageous characteristics including, but not limited to, a particular degree of elasticity, breathability, bendability, strength, moisture absorption, weight, abrasion resistance, and/or a combination thereof. Further, forming the upper 120 from an integrally knit knitted component 130 may form various features and structures of the upper 120 without the need for significant additional manufacturing steps or processes, thereby increasing production efficiency.

The knitted component 130 includes a knitted tongue 150 that is integrally knit with a knit element 132. As such, the tongue 150 and the knit element 132 are formed as a one-piece element through a knitting process and are joined in a seamless transition in at least one area. The tongue 150 of the knitted component 130 extends through the throat region 140 of the upper 120. The tongue 150 extends from a forward throat portion 146 of the throat region 140 to the ankle opening 122. Additionally, the upper 120 includes a lace 124 that extends through lace apertures 123 in the knit element 132 within the throat region 140. The lace 124 permits the wearer to adjust the fit of the upper 120 around a foot within the void and may extend over the throat region 140 of the knitted component 130.

In some aspects, the knitted component 130 includes an inlaid strand 134 that extends through the knit element 132 and passes between loops within the knit element 132. The inlaid strand 134 may extend along courses and/or along wales. When the inlaid strand 134 extends in a portion of the knit element 132 that has a single knit construction, the inlaid strand may be woven between loops. When the inlaid strand 134 extends in a portion of the knit element 132 that has a double knit construction, the inlaid strand may be woven between loops and/or extend between front and back loops. The inlaid strand 134 may provide support, stability, and structure to the article of footwear 100. For example, the inlaid strand 134 may impart stretch resistance, add structure around the midfoot region, and form lace-receiving members (e.g., lace loops), which may coincide with apertures in the knit element 132, as depicted in the example configuration in FIGS. 1 and 2. In some aspects, inlaid strands extend from an area adjacent the sole (i.e., the biteline) to an instep region, which may be the lateral throat portion 142 or the medial throat portion 144. When the lace 124 is tightened, the inlaid strand 134 may be tensioned to provide more support around a foot within the footwear 100. The inlaid strand 134 may be made of a material having different properties as the yarn(s) forming the rest of the knitted component 130. For example, the inlaid strand 134 may have a higher tenacity, a higher denier per filament, a lower elasticity than the other yarn(s) knitted together to form the knitted component 130.

Figure 3:
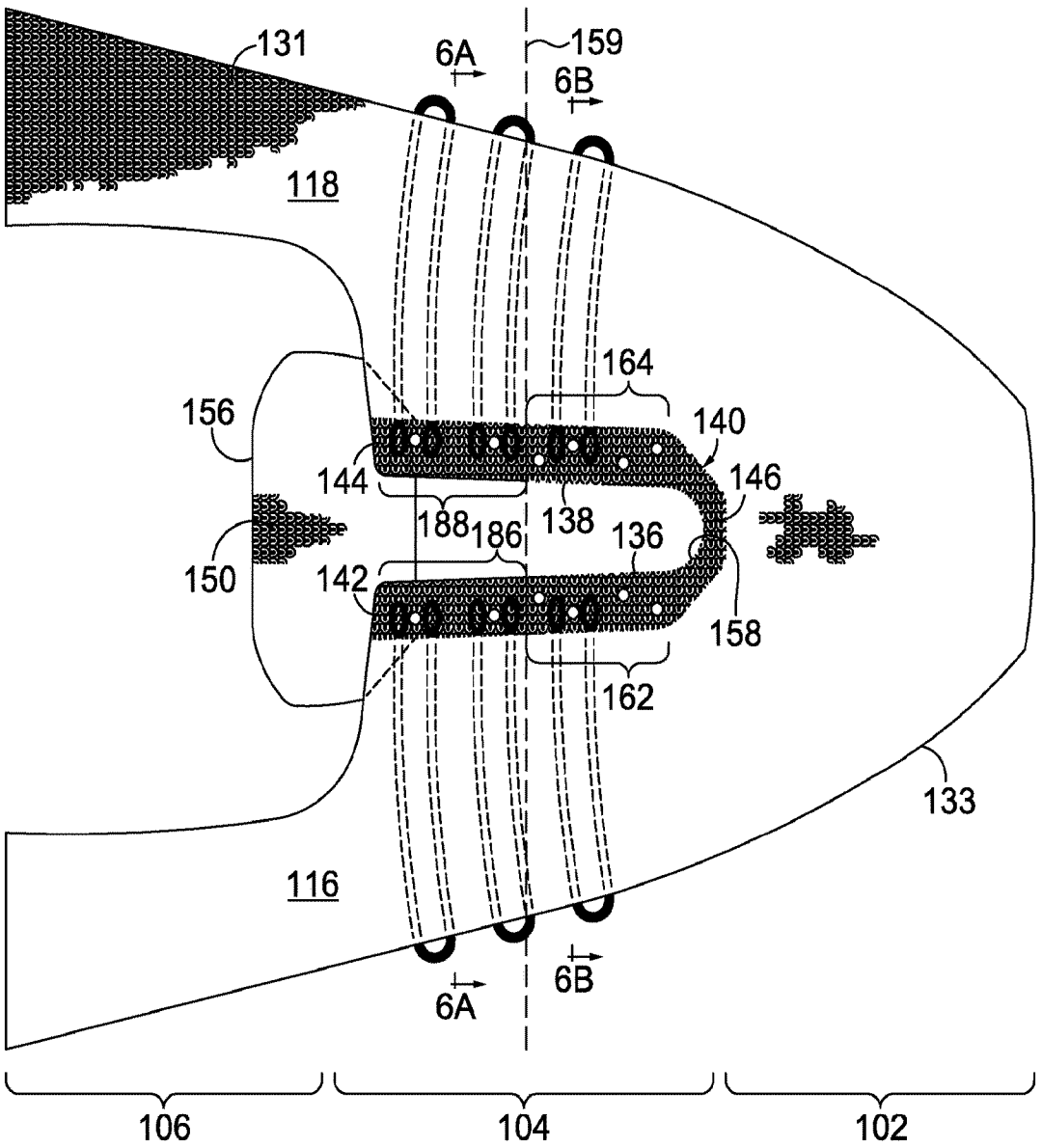
FIG. 3 depicts a top plan view of a front side of a knitted component that may be incorporated into the article of footwear of FIG. 1 in accordance with aspects herein.
Figure 4:
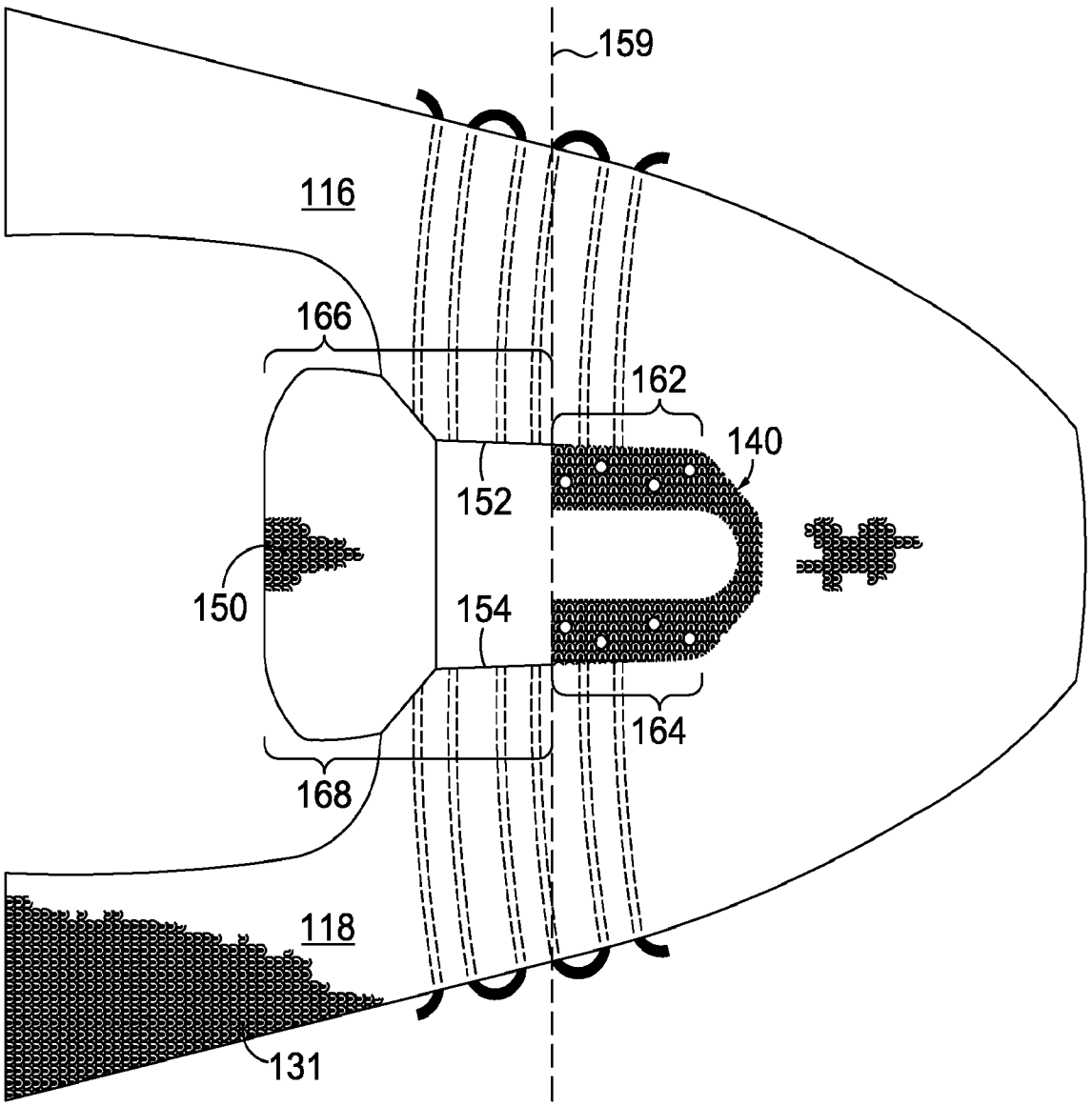
FIG. 4 depicts top plan view of a back side of a knitted component that may be incorporated into the article of footwear of FIG. 1 in accordance with aspects herein.

FIGS. 3 and 4 depict the knitted component 130 in generally planar configurations prior to being formed into the upper 120 of FIGS. 1 and 2. FIG. 3 depicts a front side of the knitted component 130 that may form the exterior surface of the upper 120, and FIG. 4 depicts a back side of the knitted component 130 that may form the interior surface of the upper 120. It should be understood that the front side of the knitted component 130 in FIG. 3 may be formed with needles of a front needle bed or a back needle bed, and the back side of the knitted component 130 in FIG. 4 may also be formed with needles of a front needle bed or a back needle bed. As such, the terms front side and back side should not be taken to limit the sides of the knitted component to a particular location on the knitting machine during knitting.

The knitted component 130 includes a knit element 132 that may form at least the forefoot region 102, the lateral side 116 of the forefoot region 102, and the medial side 118 of the midfoot region 104. The knit element 132 may also form the heel region 106 of the upper 120. As depicted, the knit element 132 may have a generally U-shaped configuration. Within this planar configuration depicted in FIGS. 3 and 4, the knit element 132 may also include perimeter edges, such as a perimeter edge 133, which may be joined to the sole structure 110 of the footwear 100 via a strobel or sockliner. The knit element 132 further includes inner edges that define the ankle opening 122 as well as a throat opening when the knitted component 130 is formed into the upper 120. For example, the throat opening is between a lateral edge 136 within the throat region 140 of the knit element 132 and a medial edge 138 within the throat region 140. Additionally, the knit element 132 includes a lateral throat portion 142 adjacent the lateral edge 136 and forming a lateral boundary of the throat region 140 and a medial throat portion 144 adjacent the medial edge 138 and forming a medial boundary of the throat region 140. The knit element 132 also includes a forward throat portion 146 joining the lateral throat portion 142 and the medial throat portion 144 and forming a boundary between the throat region 140 and the forefoot region 102.

The knitted component 130 further includes the tongue 150 that is integrally knit with the knit element 132. The tongue 150 has a width extending between a lateral edge 152 positioned within the lateral side 116 of the knitted component 130 and a medial edge 154 positioned within the medial side 118 of the knitted component 130. As the tongue 150 is knitted, the tongue 150 has one or more knit constructions. For simplicity, the tongue 150 is depicted in the figures herein as generally having a uniform knit texture except where the tongue 150 is joined to the knit element 132 as described further below, but it is contemplated that the tongue 150 may include zones of different knit constructions to form apertures, indentions, and/or padding. Additionally, other textile or non-textile layers may be secured to the tongue 150.

The knit element 132 at least partially overlaps the tongue 150. Specifically, the lateral throat portion 142 of the knit element 132 overlaps the lateral edge 152 of the tongue 150, and the medial throat portion 144 of the knit element 132 overlaps the medial edge 154 of the tongue 150. In this way, the lateral edge 152 of the tongue 150 is lateral to the lateral edge 136 of the knit element 132, and the medial edge 154 of the tongue 150 is medial to the medial edge 138 of the knit element 132.

The tongue 150 is joined to the forward throat portion 146 of the knit element 132 through knitting such that there may be a seamless knitted connection between the forward throat portion 146 and the tongue 150. The tongue 150 extends from a forward end 158 to a rearward end 156. The forward end 158 of the tongue 150 abuts the forward throat portion 146 of the knit element 132, and the rearward end 156 is an edge connecting the lateral edge 152 and the medial edge 154 and partly defines the ankle opening 122 when the knitted component 130 is formed into the upper 120.

A first knit structure 162 directly joins the tongue 150 to the lateral throat portion 142 of the knit element 132, and a second knit structure 164 directly joins the tongue 150 to the medial throat portion 144 of the knit element 132. The first knit structure 162 may extend the entire width of the lateral throat portion 142 of the knit element 132 that overlaps the tongue 150, and the second knit structure 164 may extend the entire width of the medial throat portion 144 of the knit element 132 that overlaps the tongue 150.

Figure 7:
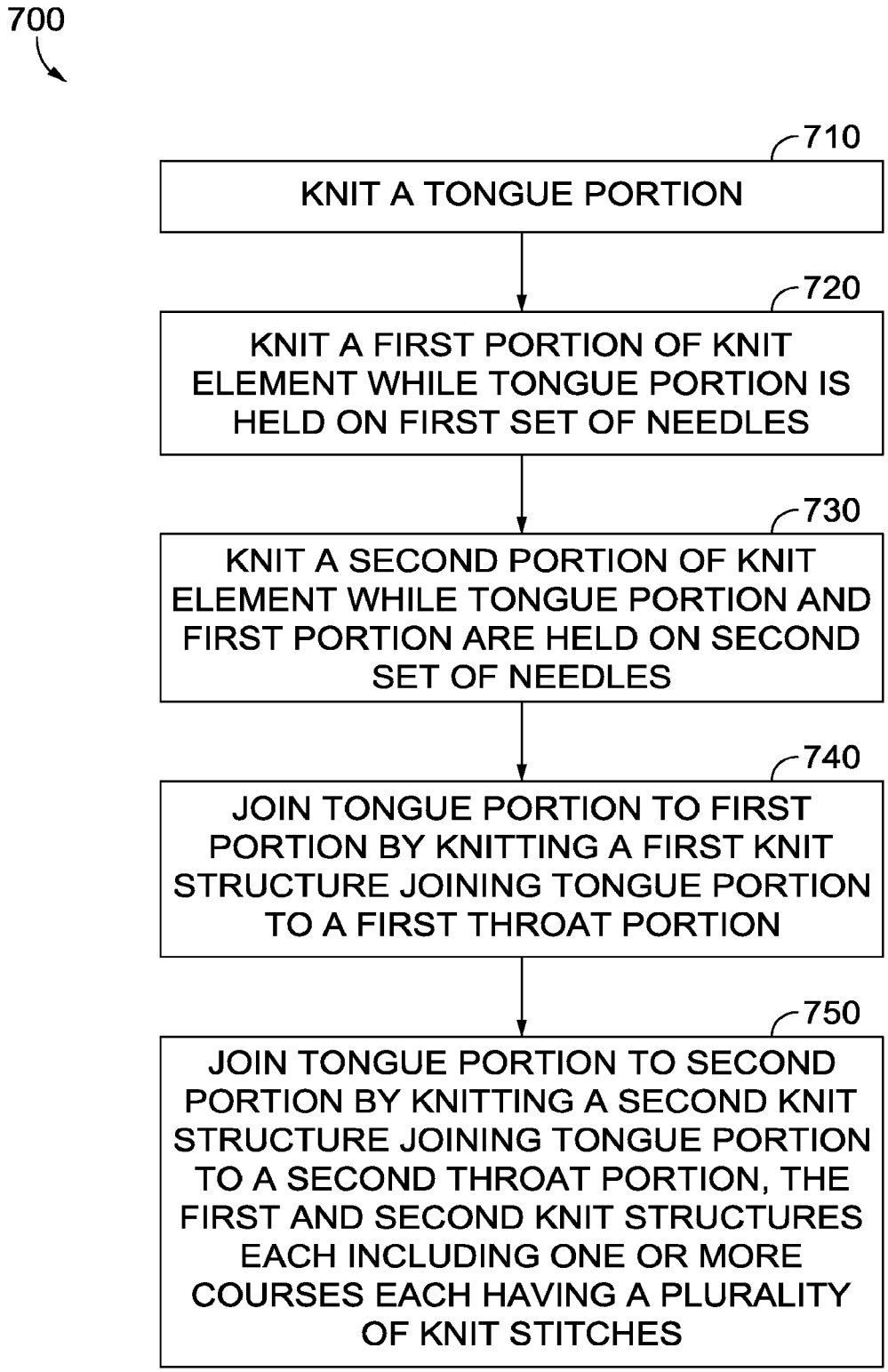
FIG. 7 depicts a flow diagram of an example method of manufacturing a knitted component for an article of footwear, in accordance with aspects herein.

As further explained with respect to FIG. 7, example aspects of the knitted component 130 are weft-knitted in a heel-to-toe direction or toe-to-heel direction such that courses may extend horizontally from the lateral side 116 to the medial side 118. As such, the first knit structure 162 may comprise a plurality of knit stitches (which may also be referred to herein as knitted loops) within the same course extending from the lateral edge 152 of the tongue 150 to the lateral edge 136 of the throat region 140, and the second knit structure 164 may comprise a plurality of knit stitches within the same course extending from the medial edge 154 of the tongue 150 to the medial edge 138 of throat region 140. The first knit structure 162 and the second knit structure 164 may each span multiple adjacent courses from the forward end 158 of the tongue 150 to a midline 159. In example aspects, the quantity of adjacent knit stitches in each course forming the first knit structure 162 is within a range from about 3 to about 12, from about 5 to about 10, from about 6 to about 9. In an example aspect, there are 8 adjacent knit stitches in each course within the first knit structure 162. The quantity of adjacent knit stitches in each course forming the second knit structure 164 may be the same as the quantity in the first knit structure 162. The use of multiple knit stitches in each course for each of the first and second knit structures 162 and 164, respectively, creates a stronger connection between the tongue 150 and the knit element 132 that is more resistant to tearing when the wearer pulls on the tongue 150 to don and/or doff the footwear 100.

The portions of the tongue 150 that are directly secured to the overlapping lateral and medial throat portions 142 and 144 of the knit element 132 via the first knit structure 162 and the second knit structure 164 may be referred to herein as secured lateral and medial sections of the tongue 150. Further, other portions of the tongue 150 may remain detached from the lateral throat portion 142 and the medial throat portion 144. For example, a detached lateral section 166 of the tongue 150 extending adjacent the lateral edge 152 and between the first knit structure 162 and the rearward end 156 may be detached, or not directly secured, to the knit element 132. A detached medial section 168 extending adjacent the medial edge 154 of the tongue 150 and between the second knit structure 164 and the rearward end 156 may also be detached, or not directly secured to, the knit element 132. A detached lateral section 186 of the lateral throat portion 142 may overlay the detached lateral section 166 of the tongue 150, and a detached medial section 188 of the medial throat portion 144 may overlay the detached medial section 168 of the tongue 150.

In some aspects, the detached sections 186 and 188 of the throat portions 142 and 144, respectively, are longer than the portions secured to the tongue 150 via the first knit structure 162 and the second knit structure 164. For example, a first terminal course and a second terminal course may define the ends of the first knit structure 162 and the second knit structure 164. The first terminal course may be immediately adjacent the detached lateral section 186 and the detached medial section 188, and the second terminal course may be immediately adjacent the forward throat portion 146. As such, the first knit structure 162 is made of a first quantity of courses consecutively extending between the forward throat portion 146 to the detached lateral section 186, and the second knit structure 164 is made of the same first quantity of courses consecutively extending between the forward throat portion 146 to the detached medial section 188 of the throat region 140. In example aspects, the first quantity of consecutive courses forming the first knit structure 162 and the second knit structure 164 is within a range from about 12 courses to about 40 courses, from about 12 courses to about 32 courses, and from about 16 courses to about 28 courses. A second quantity of consecutive courses form each of the detached lateral section 186 and the detached medial section 188 of the throat region 140, and the second quantity of courses may be greater than the first quantity of courses. In example aspects, the second quantity of consecutive courses is within a range from about 16 courses to about 25 courses, from about 18 courses to about 38 courses, and from about 20 courses to about 42 courses. By utilizing more courses in the detached sections 186 and 188 than in the knit structures 162 and 164, more of the tongue 150 may be pulled back when a wearer is putting on the footwear 100, thereby increasing the potential size of the ankle opening 122 and reducing the strain put on the connection between the tongue 150 and the knit element 132. Additionally, by utilizing a plurality of courses to form the first and second knit structures 162 and 164, rather than a single course, the knit structures 162 and 164 form a stronger connection between the tongue 150 and the knit element 132 that may withstand more strain before tearing or otherwise exhibiting wear.

In example aspects, the tongue 150 and at least part of the knit element 132 may have different knit constructions. For instance, the tongue 150 may have a higher knit gauge than at least part of the knit element 132. In one example, the tongue 150 may have a full gauge knit structure, while at least the detached sections 186 and 188 of the lateral and medial throat portions 142 and 144 may have a less-than-full gauge knit structure, such as a half gauge knit structure. A full gauge knit structure includes, within one course, knit loops formed on consecutive needles on a needle bed such that every needle within a section of the needle bed is used to knit the tongue 150. A less-than-full gauge knit structure uses less than every needle within a section of the needle bed, such as every other needle in the example of a half gauge knit structure. It is contemplated that the lateral and medial throat portions 142 and 144 have a less than half gauge knit structure, such as a third gauge knit structure (i.e., loops formed on every third needle) or quarter gauge knit structure (i.e., loops formed on every fourth needle).

Further, at least part of the tongue 150 may have a double knit construction such that there are front courses formed on a front needle bed and corresponding back courses formed on a back needle bed. A double knit construction for the tongue 150 may create a stiffer tongue 150 for additional structure and durability to the knitted component 130. At least part of the knit element 132 may have a single knit construction such that the courses are formed on one needle bed (e.g., the front needle bed or the back needle bed) at a time. The detached sections 186 and 188 of the throat region 140 of the knit element 132 may have a single knit construction, as well as a half gauge knit structure, which may help keep the detached sections 186 and 188 lying flat against the tongue 150 to maintain optimal aerodynamics and a sleeker appearance. Additionally, this knit construction and structure of the detached sections 186 and 188 allows needles to be freed up for transferring of knitted loops of the tongue 150 when the tongue 150 and the knit element 132 are joined.

Where the tongue 150 and the knit element 132 are joined through the knit structures 162 and 164 within the throat region 140, the knitted component 130 may have a double knit construction with a full gauge knit structure. In some examples, the forward throat portion 146 of the throat region 140 also includes a single knit construction with a full gauge knit structure, while in other examples, the forward throat portion 146 of the throat region 140 has a single knit construction with a half gauge knit structure. Alternatively, the forward throat portion 146 may have a double knit construction with either a half gauge or full gauge knit structure. The rest of the knit element 132, outside of the throat region 140, may have a single knit construction with a full gauge knit structure and/or a half gauge knit structure. Alternatively, the rest of the knit element 132, outside of the throat region 140 may have a double knit construction with a full gauge knit structure and/or a half gauge knit structure.

Figure 5:
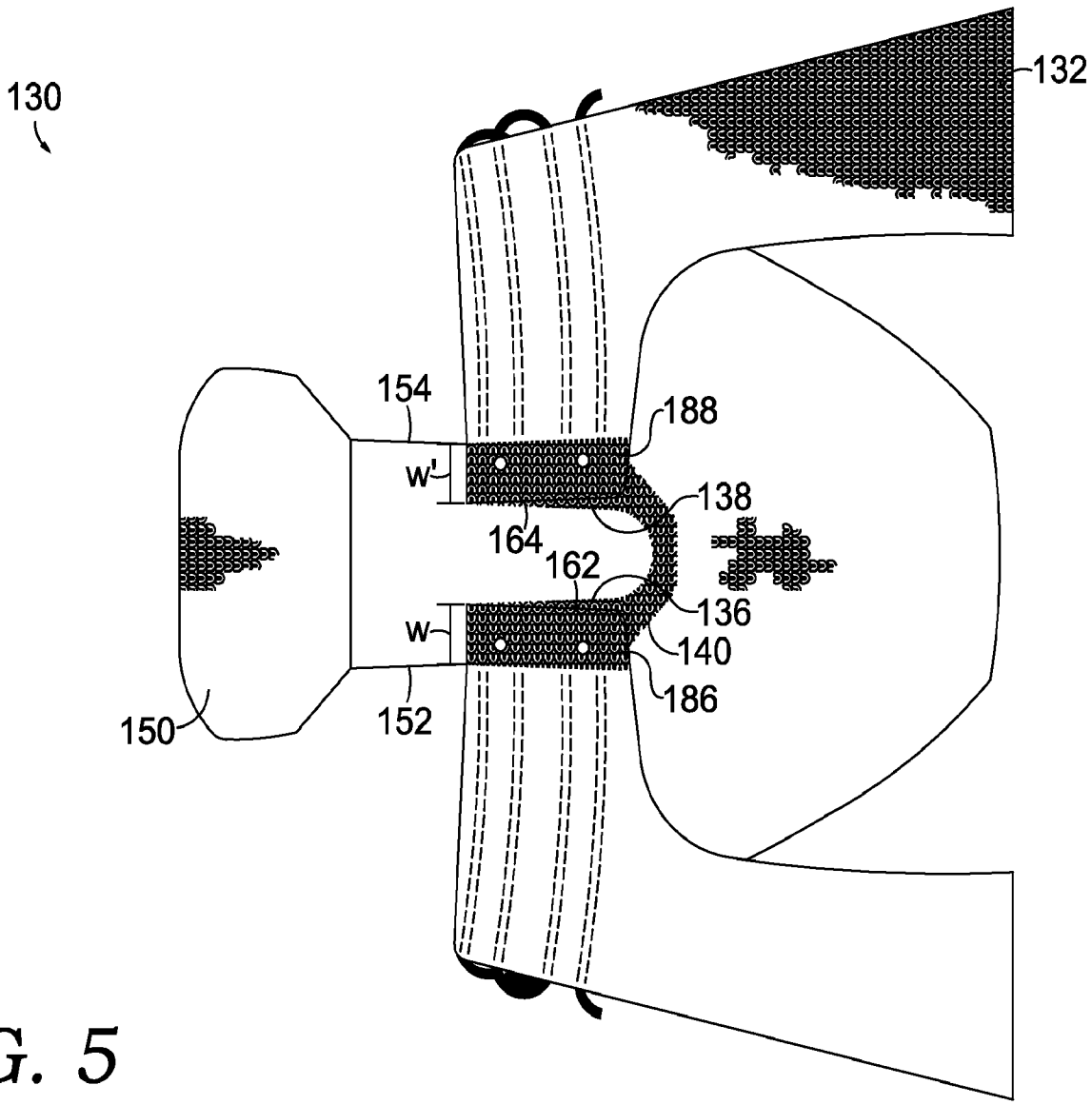
FIG. 5 depicts a top plan view of a front side of the knitted component of FIG. 3 with detached portions of the knit element folded over to expose the tongue, in accordance with aspects herein.

FIG. 5 depicts a top plan view of the knitted component 130 with the detached portions pulled back to expose the tongue 150. In this view, the detached sections 186 and 188 of the throat region 140 are lying over the first and second knit structures 162 and 164 that join the tongue 150 and the knit element 132. The first knit structure 162 has a width w between the lateral edge 152 of the tongue 150 and the lateral edge 136 of the throat region 140. The second knit structure 164 has a width w' between the medial edge 154 of the tongue 150 and the medial edge 138 of the throat region 140. The width w and the width w' may be the same. The widths w and w' of the first and second knit structures 162 and 164 may each be made of a plurality of adjacent knit stitches within the same course, where each knit stitch (i.e., loop) connects the tongue 150 and the knit element 132. In example aspects, widths w and w' may each be within a range from about 3 knit stitches to about 12 knit stitches, from about 5 knit stitches to about 10 knit stitches, from about 6 knit stitches to about 9 knit stitches. In an example aspect, widths w and w' are formed by 8 adjacent knit stitches each joining the knit element 132 and the tongue 150. Using multiple knit stitches extending across widths w and w' creates a stronger connection between the tongue 150 and the knit element 132 that is more resistant to tearing when the wearer pulls on the tongue 150 to don and/or doff the footwear 100.

Figure 6A:
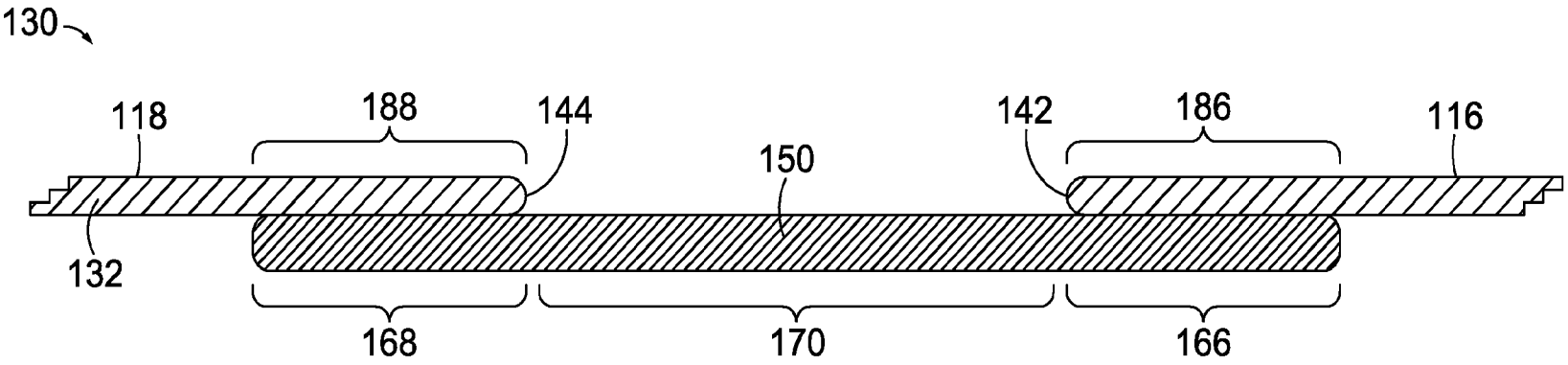
FIGS. 6A and 6B depict cross-sectional views of the knitted component of FIG. 3, taken at reference lines 6A and 6B in FIG. 3 in accordance with aspects herein.
Figure 6B:
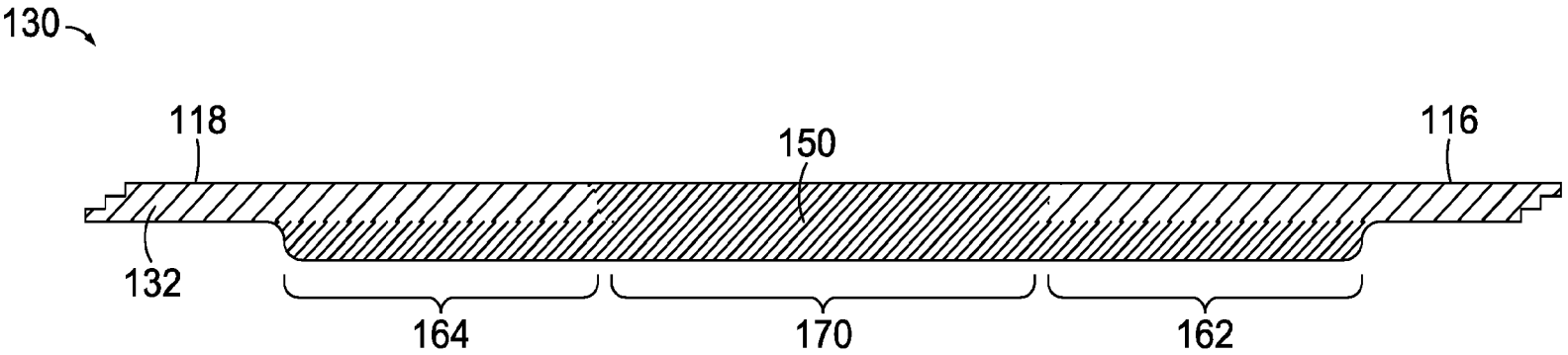

FIGS. 6A and 6B depict cross-sectional views of portions of the knitted component 130 taken along the reference lines indicated in FIG. 3. FIG. 6A depicts a cross-sectional view of the knitted component 130 taken along reference line 6A-6A, which extends in a lateral-medial direction and extends across detached sections 166 and 168 of the tongue 150 and detached sections 186 and 188 of the knit element 132. As depicted, the lateral and medial throat portions 142 and 144, respectively, of the throat region 140 within the knit element 132 overlap and extend over portions of the tongue 150. Specifically, the detached lateral section 186 of the lateral throat portion 142 of the knit element 132 overlaps the detached lateral section 166 of the tongue 150, and the detached medial section 188 of the medial throat portion 144 of the knit element 132 overlaps the detached medial section 168 of the tongue 150. A middle portion 170 of the tongue 150 is not covered by the knit element 132 and is exposed between the lateral and medial throat portions 142 and 144. Within this region of the knitted component 130, the tongue 150 and the knit element 132 are unsecured to one other so that the tongue 150 may move independently of the knit element 132, such as when a wearer pulls the tongue 150 up and away from the knit element 132 when putting on the article of footwear 100.

FIG. 6B depicts a cross-sectional view of the knitted component 130 taken along reference line 6B-6B, which extends in a lateral-medial direction and extends across the first and second knit structures 162 and 164. The first and second knit structures 162 and 164 join the tongue 150 and the knit element 132 such that the tongue 150 and the knit element 132 are integrally knitted together in a seamless manner. In other words, the tongue 150 and the knit element 132 have a unitary knit construction. The configuration depicted in FIG. 6B may be similar to other cross-sectional views taken at various reference lines between the midline 159 in FIG. 3 and the forward throat portion 146.

FIG. 7 illustrates a flow diagram depicting an example method 700 of manufacturing a knitted component of an article of footwear, such as the knitted component 130 of the article of footwear 100 of FIGS. 1-6B. The steps provided in method 700 are merely illustrative, and method 700 may include additional steps that are not illustrated. At least some of the steps of method 700 are indicated as being performed on a knitting machine, which may be an automated knitting machine. As such, one or more of these steps may be performed and/or controlled using a control unit having a processor or computer communicatively coupled with or integrated into the knitting machine. In example aspects, the knitting machine used to carry out steps of method 700 is a V-bed flat knitting machine having two needle beds—a front needle bed and a back needle bed—that are angled relative to each other to form a V-bed. The front and back needle beds may each include a plurality of individual needles extending across a common plane. A carriage may move feeders, such as standard and/or combination feeders, along the front and back needle beds to supply yarns to needles. Generally, standard feeders and combination feeders both supply yarn for needles to knit, tuck, and/or float, while combination feeders may also supply yarn to inlay through or between knitted structures, such as the inlaid strand 134. Although a flat V-bed knitting machine is described herein, it should be understood that this is one example and that other knitting machines may be used be used to form the knitted component or a portion thereof. Similarly, in example aspects, the knitting steps within method 700 may be weft-knitting processes, but in alternative aspects, warp-knitting processed may be used.

At step 710 of method 700, at least a portion of a tongue is knitted with a knitting machine. The tongue portion may have the configuration of the tongue 150 of the footwear 100 in FIGS. 1-6B. The tongue portion may be knit with a first yarn on a front needle bed and a second yarn on the back needle bed so that the tongue portion may have a double knit construction. The first yarn and the second yarn may be two ends of the same type of yarn. In other aspects, the first yarn and the second yarn may have different material properties, such as color, elasticity, denier per filament, and/or tenacity, for example. The tongue portion may be knit in a rear-to-forward direction such that the first course that is knit in step 710 may form a rearward end (e.g., the rearward end 156), and subsequent courses may form more forward areas of the tongue portion.

At step 720, a first portion of a knit element (e.g., knit element 132) is knit with the knitting machine. The first portion may form part of a first side, such as a lateral side (e.g., the lateral side 116) or a medial side (e.g., medial side 118) of the knitted component. Within the first side, the first portion may include a heel region (e.g., the heel region 106) and, in some aspects, part of a midfoot region (e.g., the midfoot region 104). The first portion may also include a first throat portion, which may be either a lateral throat portion or a medial throat portion. For instance, where the first portion forms a lateral side, the first portion may include a lateral throat portion (e.g., the lateral throat portion 142), and where the first portion forms a medial side, the first portion may include a medial throat portion (e.g., the medial throat portion 144). Similar to the tongue portion, the first portion may be knit in step 720 in a rear-to-forward direction such that the first course knit in the heel region may be formed prior to the midfoot region.

While the first portion is being knitted at step 720, the tongue portion is held on a first set of needles. By holding the tongue portion, the tongue portion remains stationary on the knitting machine while the first portion is knit. Prior to knitting the first portion at step 720, method 700 may include transferring the tongue portion to the first set of needles. While the tongue portion may be knit on back and front needle beds as explained above, the first set of needles holding the tongue portion may be on only one needle bed. In some aspects, loops forming the tongue portion that are on the back needle bed are transferred to the first set of needles on the front needle bed, but it should be understood that, alternatively, the loops on the front needle bed may be transferred to the first set of needles on the back needle bed.

At least the throat portion—the lateral throat portion or the medial throat portion—of the first portion knit at step 720 may be formed on a single needle bed to create a single knit construction. For instance, the throat portion may be formed with the first yarn on the front needle bed or the second yarn on the back needle bed. In some aspects, a third yarn having a different material property than the first and second yarns may be used to knit the throat portion on either the front needle bed or the back needle bed. Additionally, at least the throat portion of the first portion knit at step 720 may be formed as a half gauge knit structure by using only every other needle to manipulate the yarn forming the throat portion. In this way, the throat portion may have a half gauge knit structure. In some aspects, the throat portion has a lower gauge knit structure, such as a third gauge knit structure (i.e., knit on every third needle) or a quarter gauge knit structure (i.e., knit on every fourth needle). Other areas of the first portion, such as the heel region, may be knit with a different construction than the throat portion. For instance, other parts of the first portion may have a single knit construction with a full gauge knit structure or a double knit construction with either a full gauge knit structure or a less gauge knit structure.

Aspects of method 700 may also include shifting either the front needle bed or the back needle bed to the right or left by a predetermined distance, which may be measured in the number of needles on the bed. The process of shifting a needle bed may also be referred to herein as racking. The purpose of shifting the needle bed is to arrange the tongue portion and the first portion so that they overlap in areas to be joined later. As such, the needle bed that is shifted may be shifted in a direction that is closer to the other knit portion. For instance, where the tongue portion is held on the first set of needles on the front needle bed, the front needle bed may be shifted in a direction (either right or left) that is towards where the first portion is being held.

At step 730, method 700 includes knitting a second portion of the knit element with the knitting machine. The second portion may form part of a second side, such as a lateral side (e.g., the lateral side 116) or a medial side (e.g., medial side 118) of the knitted component. The second side is opposite the first side. As such, where the first portion forming a lateral side is knit in step 720, the second portion forms a medial side, and where the first portion forming a medial side is knit in step 720, the second portion forms a lateral side. Aside from forming an opposite side, the second portion may have the same configuration as the first portion. For example, the second portion may include a heel region and, in some aspects, part of a midfoot region. The second portion may also include a second throat portion, which may be either a lateral throat portion or a medial throat portion. At least part of the second portion, such as the second throat portion, may be formed with one needle bed to create a single knit construction. In some aspects, at least part of the second portion, such as the second throat portion, may be knit with less than every adjacent needle, such as every other needle, so that it has a lesser gauge knit structure, such as a half gauge knit structure. Other areas of the second portion, such as the heel region, may be knit with a different construction than the throat portion. For instance, other parts of the second portion may have a single knit construction with a full gauge knit structure or a double knit construction with either a full gauge knit structure or a lesser gauge knit structure.

While the second portion is being knitted at step 730, the overlapping tongue portion and first portion are held on a second set of needles. As such, the tongue portion and the first portion may remain stationary on the knitting machine while the second portion is being knitted. Prior to knitting the second portion at step 730, method 700 may include transferring the tongue portion and/or first portion so that the tongue portion and the first portion are held by the second set of needles on one needle bed, such as the front needle bed. The second set of needles may have a greater quantity of needles than the first set used to hold only the tongue portion during step 720. The first set of needles may be a subset of the second set of needles.

Aspects of method 700 may also include shifting either the front needle bed or the back needle bed to the right or left by a predetermined distance, which may be measured in the number of needles on the bed. This second instance of shifting, or racking, may be done so that the tongue portion and the second portion overlap. As such, the needle bed that is shifted may be shifted in a direction to bring the tongue portion and the second portion towards each other. This shifting of the needles will also bring the first portion that is being held with the tongue portion closer to the second portion. This process may be similar as described above for overlapping the tongue portion and the first portion.

Step 740 of method 700 includes joining the tongue portion to the first portion of the knit element, and step 750 includes joining the tongue portion to the second portion of the knit element. The tongue portion and the first portion are joined through knitting a first knit structure, and the tongue portion and the second portion are joined through knitting a second knit structure. Where the first portion forms a lateral side, the first knit structure may be similar to the first knit structure 162 described in connection to FIGS. 1-6B and join a lateral throat portion to the tongue portion, and the second knit structure may be similar to the second knit structure 164 described in connection to FIGS. 1-6B and join a medial throat portion to the tongue portion. However, it should be understood that, alternatively, the first knit structure may join a medial throat portion to the tongue portion while the second knit structure may join a lateral throat portion to the tongue portion. Knitting the first knit structure includes knitting a course that is continuous with a course from each of the tongue portion and the first portion so that the tongue portion and the first portion may be joined in a seamless fashion. Similarly, the second knit structure is formed by knitting a course that is continuous with a course from each of the tongue portion and the second portion to create a seamless union of the tongue portion and the second portion.

The first and second knit structures may be knit with needles on both the front needle bed and the back needle bed so that the first and second knit structures may each have a double knit construction. The first and second knit structures may also be knitted with adjacent needles to create a full gauge knit structure. The first knit structure may include a width equal to the overlap between the tongue portion and the first portion, and the second knit structure may similarly have a width equal to the overlap between the tongue portion and the second portion. In example aspects, the first knit structure and the second knit structure are each created by knitting a plurality of consecutively formed knit stitches within each course of the respective knit structure. The quantity of consecutive knit stitches within a course forming the first and second knit structures may be in a range from about 3 knit stitches to about 12 knit stitches, from about 5 knit stitches to about 10 knit stitches, from about 6 knit stitches to about 9 knit stitches. In an example aspect, knitting the first knit structure includes forming 8 adjacent knit stitches in each course, and knitting the second knit structure includes forming 8 adjacent knit stitches in each course. As the first and second knit structures may be double knit constructions, steps 740 and 750 may each include forming 8 adjacent knit stitches on a front needle bed and forming 8 adjacent knit stitches on a back needle bed.

The predetermined distance used for shifting a needle bed after forming each of the first and second portions may be based on the distance between the tongue portion and respective portion of the knit element (i.e., the first portion or the second portion) as well as the intended width of the knit structure that will be used to join the tongue portion and the knit element. In one example, the first portion of the knit element and the tongue portion are separated by ten needle positions after the first portion is knitted, and the intended width of a first knit structure joining the tongue portion and the first portion is eight knit stitches (i.e., eight needle positions in a full gauge). In this example, after the first portion is knitted, one of the needle beds may be shifted to one side by 18 needle positions. The predetermined distance used for shifting a needle bed after forming the second portion in order to create the second knit structure may be the same or at least determined in the same manner as described for the first knit structure.

Steps 740 and 750 may include knitting a plurality of adjacent courses to form the first and second knit structures so that the first and second knit structures each span multiple courses. In example aspects, steps 740 and 750 include knitting a quantity of adjacent courses that is within a range from about 12 courses to about 40 courses, from about 12 courses to about 32 courses, and from about 16 courses to about 28 courses. Each of these courses have the quantity of knit stitches described above with respect to the first and second knit structures.

Steps 740 and 750 may be performed at the same time or in conjunction with one another. In example aspects of this disclosure, the tongue portion has a seamless transition with both the first portion and the second portion. Courses forming the first knit structure joining the tongue portion and the first portion may be continuous with courses forming the second knit structure joining the tongue portion and the second portion. For instance, a course may be knitted with knit stitches forming the first knit structure, followed by knit stitches (which may include other types of stitches, such as floats) forming a central tongue portion, which may be followed by knit stitches forming the second knit structure. As a carriage of the knitting machine changes direction to move to the other side of the machine, the sequence for another course may be reversed.

Further, when the first knit structure is formed at step 740 and/or when the second knit structure is formed at step 750, additional knit stitches may be knitted in each course to create medial and/or lateral aspects of the knit element that are continuous with the respective knit structure. For instance, immediately prior to knitting a set of knit stitches for the first knit structure, such as eight knit stitches, another set of consecutive knit stitches, which may have a greater quantity then the set forming the first knit structure, may be formed. This other set of consecutive knit stitches may be within the same course as the first knit structure and, as such, have a common yarn with the first knit structure. In this way, the first knit structure may have a seamless, unitary knit construction with the rest of the knit element. Similar additional sets of knit stitches may be continuously formed immediately after and/or before forming the knit stitches for the second knit structure.

In example aspects, the first and second knit structures each has a double knit construction while other parts of the knit element may have a single knit construction. As such, step 740 may include knitting a first set of knit stitches on one needle bed and continuously knitting a second set of knit stitches on both needle beds (e.g., 8 front knit stitches and 8 back knit stitches). This step may be performed in the reverse order. Similarly, step 750 may include knitting a third set of stitches on both needle beds (e.g., 8 front knit stitches and 8 back knit stitches) to form the second knit structure and continuously knitting a fourth set of knit stitches on one needle bed. This step may be performed in the reverse order. The second and third sets of knit stitches may be formed on adjacent needles to create full gauge knit structures. In some example aspects, the first and fourth sets of knit stitches are not formed on adjacent needles to create a lesser gauge knit structure, such as forming knit stitches on every other needle. Alternatively, the first and fourth sets may be knitted on adjacent needles to create full gauge knit structures.

Some aspects of method 700 include knitting a third portion of the knit element after joining the tongue portion to the first and second portions. The third portion may be knitted continuously with the tongue portion, the first portion, and the second portion. The third portion may form a foreword throat portion. Additionally, the third portion may define a forefoot region in the medial side and lateral side of the article of footwear. While courses used to continuously join the tongue portion and the first and second portions may have varying knit constructions and/or structures (e.g., double and single knit constructions, full and half gauge knit structures), at least one or more courses within the third portion may have a uniform construction extending from a lateral edge of the knit element to a medial edge of the knit element.

Further, some aspects of method 700 may include creating the knitted component with additional structures, such as inserting an inlaid strand (e.g., inlaid strand 134) within the first portion and/or the second portion using a combination feeder. Additionally, method 700 may also include removing the knitted component from the knitting machine, forming the knitted component into an upper for an article of footwear and securing the knitted component to one or more sole structures, such as a sockliner, a midsole, or an outsole.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1: An article of footwear comprising: a knit element at least partially forming an upper for the article of footwear, the knit element extending through at least part of a forefoot region of the upper and at least part of a throat region of the upper; and a tongue integrally knit with the knit element, the tongue extending through the throat region of the upper and having a lateral edge and a medial edge, wherein the knit element includes a lateral throat portion that overlaps the lateral edge of the tongue and a medial throat portion that overlaps the medial edge of the tongue, wherein a first knit structure joins the tongue to the lateral throat portion of the knit element, and wherein a second knit structure joins the tongue to the medial throat portion of the knit element, the first knit structure and the second knit structure each comprising one or more courses each having a plurality of knit stitches.

Clause 2: The article of footwear according to clause 1, wherein the plurality of knit stitches in each course of the first knit structure and the second knit structure is within a range of five to ten knit stitches.

Clause 3: The article of footwear according to any of clauses 1-2, wherein the tongue comprises a forward end adjacent the forefoot region of the upper and a rearward end opposite the forward end, wherein the tongue further includes: a detached lateral section extending between the first knit structure and the rearward end; and a detached medial section extending between the second knit structure and the rearward end, wherein the detached lateral section and the detached medial section of the tongue are configured to move independently from the knit element.

Clause 4: The article of footwear according to any of clauses 1-3, wherein the lateral throat portion of the knit element includes a detached lateral section that overlaps the detached lateral section of the tongue, and the medial throat portion of the knit element includes a detached medial section that overlaps the detached medial section of the tongue.

Clause 5: The article of footwear according to any of clauses 1-4, wherein the first knit structure and the second knit structure each include a first quantity of consecutive courses, the detached lateral section of the lateral throat portion and the detached medial of the medial throat portion each include a second quantity of consecutive courses that is greater than the first quantity of consecutive courses.

Clause 6: The article of footwear according to any of clauses 1-5, wherein the tongue has a full gauge knit structure.

Clause 7: The article of footwear according to any of clauses 1-6, wherein at least part of the lateral throat portion and at least part of the medial throat portion of the knit element each has a half gauge knit structure.

Clause 8: The article of footwear according to any of clauses 1-7, wherein the tongue has a double knit construction.

Clause 9: An article of footwear comprising: a knit element at least partially forming an upper for the article of footwear, the knit element extending through at least part of a forefoot region of the upper and at least part of a throat region of the upper; a tongue integrally knit with the knit element, the tongue extending through the throat region of the upper and having a lateral edge and a medial edge; and a sole component secured to upper, wherein the knit element includes a lateral throat portion that overlaps the lateral edge of the tongue and a medial throat portion that overlaps the medial edge of the tongue, wherein a first knit structure joins the tongue to the lateral throat portion of the knit element, and wherein a second knit structure joins the tongue to the medial throat portion of the knit element, the first knit structure and the second knit structure each comprising one or more courses each having a plurality of knit stitches.

Clause 10: The article of footwear according to clause 9, wherein the plurality of knit stitches in each course of the first knit structure and the second knit structure is within a range of five to ten knit stitches.

Clause 11: The article of footwear according to any of clauses 9-10, wherein the tongue has a full gauge knit structure, and wherein at least part of the lateral throat portion of the knit element and at least part of the medial throat portion of the knit element each has a half gauge knit structure.

Clause 12: The article of footwear according to any of clauses 9-11, wherein the tongue has a double knit construction.

Clause 13: The article of footwear according to any of clauses 9-12, wherein the first knit structure and the second knit structure each has a double knit construction, and wherein at least part of the lateral throat portion of the knit element and at least part of the medial throat portion of the knit element each has a single knit construction.

Clause 14: The article of footwear of according to any of clauses 9-13, wherein the knit element further forms a lateral side of a midfoot region and a medial side of the midfoot region that are each integrally knit with the forefoot region.

Clause 15: A method of manufacturing a knitted component for an article of footwear, the method comprising: knitting a tongue portion with a knitting machine; knitting a first portion of a knit element with the knitting machine while the tongue portion is held on a first set of needles, the first portion including a first throat portion forming one of a lateral throat portion or a medial throat portion; knitting a second portion of the knit element with the knitting machine while the tongue portion and the first portion are held on a second set of needles, the second portion including a second throat portion forming the other of the lateral throat portion or the medial throat portion; joining the tongue portion to the first portion of the knit element by knitting a first knit structure to join the tongue portion to the first throat portion; and joining the second portion to the tongue portion and the first portion by knitting a second knit structure to join the tongue portion to the second throat portion; wherein the first knit structure and the second knit structure each comprise one or more courses each having a plurality of knit stitches.

Clause 16: The method of manufacturing according to clause 15, wherein the plurality of knit stitches in each course of the first knit structure and the second knit structure is within a range from five to ten knit stitches.

Clause 17: The method of manufacturing according to any of clauses 15-16, further comprising knitting a third portion of the knit element after joining tongue portion to the first portion and the second portion, the third portion forming at least a forward throat portion.

Clause 18: The method of manufacturing according to any of clauses 15-17, wherein the tongue portion is stationary while the first portion and the second portion of the knit element are knitted, and wherein the tongue portion, the first portion, and the second portion move together while the third portion of the knit element is knitted.

Clause 19: The method of manufacturing according to any of clauses 15-18, wherein the first knit structure and the second knit structure each has a full gauge knit structure.

Clause 20: The method of manufacturing according to any of clauses 15-19, wherein the lateral throat portion in the first portion and the medial throat portion in the second portion each has a half gauge knit structure.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

The invention claimed is:

1. An article of footwear, comprising:

a knit element at least partially forming an upper for the article of footwear, the knit element extending through at least part of a forefoot region of the upper and at least part of a throat region of the upper; and a tongue integrally knit with the knit element, the tongue extending through the throat region of the upper and having a lateral edge and a medial edge, wherein the knit element comprises a lateral throat portion that overlaps the lateral edge of the tongue and a medial throat portion that overlaps the medial edge of the tongue, wherein a first knit structure joins the tongue to the lateral throat portion of the knit element, wherein a second knit structure joins the tongue to the medial throat portion of the knit element, wherein the first knit structure and the second knit structure each comprise multiple adjacent courses each having a plurality of knit stitches, and wherein each knit stitch connects a course of the tongue and a course of the knit element.

2. The article of footwear of claim 1, wherein the plurality of knit stitches in each course of the first knit structure and the second knit structure is within a range of five to ten knit stitches.

3. The article of footwear of claim 1, wherein the tongue comprises a forward end adjacent the forefoot region of the upper and a rearward end opposite the forward end, wherein the tongue further includes:

a detached lateral section extending between the first knit structure and the rearward end; and a detached medial section extending between the second knit structure and the rearward end, wherein the detached lateral section and the detached medial section of the tongue are configured to move independently from the knit element.

4. The article of footwear of claim 3, wherein the lateral throat portion of the knit element includes a detached lateral section that overlaps the detached lateral section of the tongue, and the medial throat portion of the knit element includes a detached medial section that overlaps the detached medial section of the tongue.

5. The article of footwear of claim 4, wherein the first knit structure and the second knit structure each include a first quantity of consecutive courses, the detached lateral section of the lateral throat portion and the detached medial of the medial throat portion each include a second quantity of consecutive courses that is greater than the first quantity of consecutive courses.

6. The article of footwear of claim 1, wherein the tongue has a full gauge knit structure.

7. The article of footwear of claim 6, wherein at least part of the lateral throat portion and at least part of the medial throat portion of the knit element each has a half gauge knit structure.

8. The article of footwear of claim 1, wherein the tongue has a double knit construction.

9. An article of footwear, comprising:

a knit element at least partially forming an upper for the article of footwear, the knit element extending through at least part of a forefoot region of the upper and at least part of a throat region of the upper;

a tongue integrally knit with the knit element, the tongue extending through the throat region of the upper and having a lateral edge and a medial edge; and a sole component secured to upper, wherein the knit element comprises a lateral throat portion that overlaps the lateral edge of the tongue and a medial throat portion that overlaps the medial edge of the tongue, wherein a first knit structure joins the tongue to the lateral throat portion of the knit element, wherein a second knit structure joins the tongue to the medial throat portion of the knit element, wherein the first knit structure and the second knit structure each comprise multiple adjacent courses each having a plurality of knit stitches, and wherein each knit stitch connects a course of the tongue and a course of the knit element.

10. The article of footwear of claim 9, wherein the plurality of knit stitches in each course of the first knit structure and the second knit structure is within a range of five to ten knit stitches.

11. The article of footwear of claim 9, wherein the tongue has a full gauge knit structure, and wherein at least part of the lateral throat portion of the knit element and at least part of the medial throat portion of the knit element each has a half gauge knit structure.

12. The article of footwear of claim 9, wherein the tongue has a double knit construction.

13. The article of footwear of claim 9, wherein the first knit structure and the second knit structure each has a double knit construction, and wherein at least part of the lateral throat portion of the knit element and at least part of the medial throat portion of the knit element each has a single knit construction.

14. The article of footwear of claim 9, wherein the knit element further forms a lateral side of a midfoot region and a medial side of the midfoot region that are each integrally knit with the forefoot region.

* * * * *